US008783741B2

(12) United States Patent
Marocco

(10) Patent No.: US 8,783,741 B2
(45) Date of Patent: Jul. 22, 2014

(54) SHUTTER FRAME LOCK

(75) Inventor: Mario M Marocco, Toronto (CA)

(73) Assignee: Maxxmar Inc., Toronto, Ontario (CA)

( * ) Notice: Subject to any disclaimer, the term of this patent is extended or adjusted under 35 U.S.C. 154(b) by 212 days.

(21) Appl. No.: 13/137,850

(22) Filed: Sep. 19, 2011

(65) Prior Publication Data

US 2013/0069374 A1 Mar. 21, 2013

(51) Int. Cl.
*E05C 19/18* (2006.01)

(52) U.S. Cl.
USPC ..... 292/288; 292/289; 292/303

(58) Field of Classification Search
USPC ..... 292/289, 297, 303, 338, DIG. 6, DIG. 7, 292/DIG. 35; 49/504, 73.1; 160/98, 107
See application file for complete search history.

(56) References Cited

U.S. PATENT DOCUMENTS

| | | | | |
|---|---|---|---|---|
| 1,866,882 | A * | 7/1932 | Dixson | 160/40 |
| 4,423,897 | A * | 1/1984 | Williams | 292/288 |
| 5,921,028 | A * | 7/1999 | Marocco | 49/403 |
| 6,145,251 | A * | 11/2000 | Ricci | 49/82.1 |
| 6,401,395 | B2 * | 6/2002 | Gabriele | 49/403 |
| 6,601,353 | B2 * | 8/2003 | Gabriele | 52/202 |
| 7,694,461 | B2 * | 4/2010 | Marocco | 49/394 |
| 8,371,355 | B2 * | 2/2013 | Santoro et al. | 160/269 |
| 2011/0099906 | A1 * | 5/2011 | Marocco | 49/91.1 |

* cited by examiner

*Primary Examiner* — Kristina Fulton
*Assistant Examiner* — Faria Ahmad

(57) ABSTRACT

A shutter frame lock formed of thermoplastic material for incorporation between a shutter frame and a mounting frame and having a recess integrally formed in a first one of the frames, a one piece moulded locking member secured in a second one of the frames; in which the locking member defines a main body; attachment extensions on the main body engageable with the second frame; a flexible resilient lock strip integrally moulded with the main body, having a lock portion interlockable with the recess in the first frame, and integral flexible arms extending on either side of the lock portion, joining it to the main body.

8 Claims, 4 Drawing Sheets

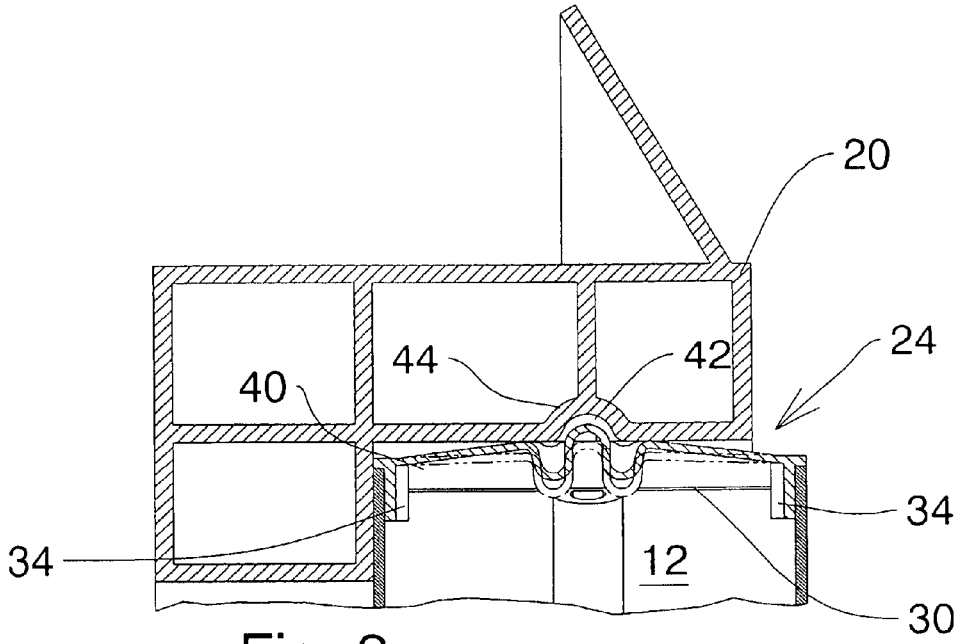
Fig. 2
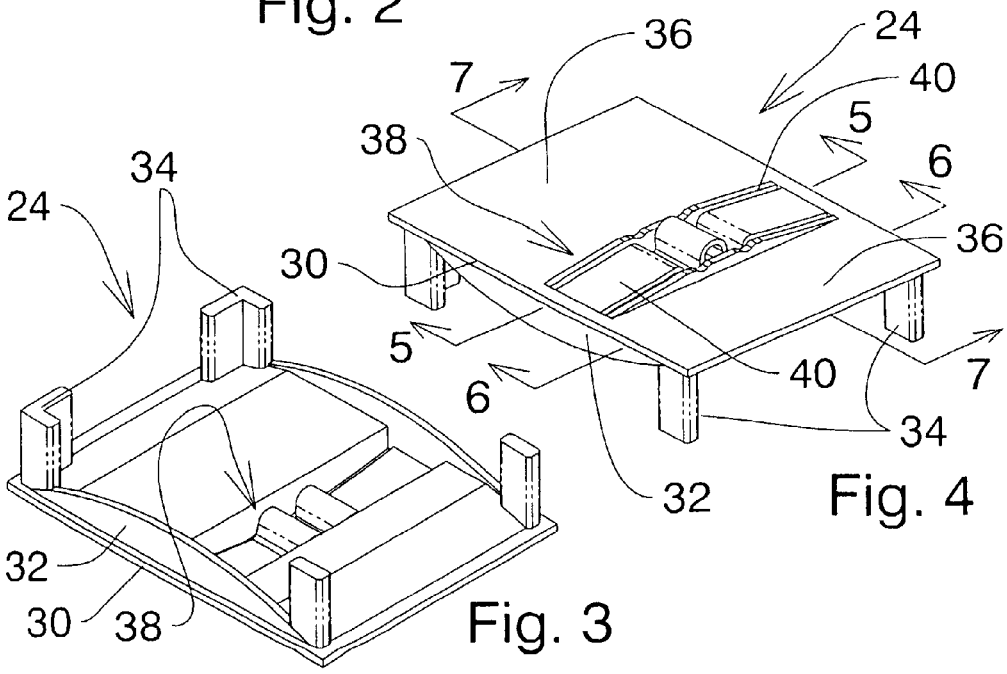
Fig. 4
Fig. 3

SHUTTER FRAME LOCK

FIELD OF THE INVENTION

The invention relates to a lock for locking shutter frames, and in particular to a frictional locking device formed of thermoplastic material which can be associated with a shutter frame of thermoplastic material, without the use of extra fastenings, screws, drills and the like during original manufacture.

BACKGROUND OF THE INVENTION

Shutters for windows, doors and building openings are now commonly made with rectangular frames of extruded thermoplastic material. Louvres extend across the frame which are also usually made of thermoplastic material.

The shutter frame is itself hingedly mounted by suitably hinges in a border frame, and the border frame is secured to the building fabric around the opening.

The border frame is also formed on thermoplastic material.

The shutter may thus be swung open, or swung closed, as desired.

In the past it has been usual to provide some form of friction lock device on the shutter frame, and the border frame which locks the shutter frame closed.

These devices typically have been similar to cupboard door locks, such as some form of spring loaded ball device, in one frame, and a socket in the other frame. The ball seats in the socket when the frame or door is closed, and holds it closed.

Such devices have been satisfactory, as locks, in most cases. However over time they are prone to failure, due simply to wear, unless made to high standards.

A more serious disadvantage is that they are troublesome to install. The installer must use considerable skill, and must get the ball, and socket in the correct positions, and in alignment, so as to work effectively. This is particularly troublesome when working with frames made of thermoplastic material. Such frames are usually formed by extrusion, and define a series of hollow tubes, and thin walls enclosing the tubes.

Securing a typical ball and socket type lock, or indeed many similar types of locking devices, in frames with hollow interiors, requires skill and ingenuity.

A still further problem is that such locks in the past have been usually installed only along the bottom portions of the two frames.

The ball (or other lock) exerts continuous pressure, tending to widen the gap between the border frame and the shutter frame. This stresses the frame itself. It also stresses the hinges.

Eventually, especially in the case of frames made of thermoplastic material, the frames become distorted. Thermoplastic material is well known to have a fatigue life much less than that of wood, or metal. Repair of a distorted shutter frame is difficult especially since such thermoplastic material once damaged will always be weak.

Clearly there is a need for a lock for such thermoplastic shutter frames, which is of low cost, and which can be incorporated in the frames themselves during original manufacture, thus avoiding later installation, and especially which avoids the problem of stressing the frames and distorting them.

BRIEF SUMMARY OF THE INVENTION

With a view to overcoming these various conflicting problems, the invention provides a shutter frame lock formed of thermoplastic material for incorporation between a shutter frame and a border frame and comprising a recess integrally formed in a first one of said frames, and a one piece moulded locking member secured in a second one of said frames, said locking member defining a main body, attachment extensions on said main body engageable with said second frame, and a flexible resilient lock strip integrally moulded with said main body, having a lock abutment interlockable with said recess in said first frame, and integral flexible arms extending on either side of said lock abutment, joining it to said main body.

Further, such locking member defines generally planar cover portions on either side of said lock strip, and being spaced therefrom so as to permit said lock strip and flexible arms to flex relative to said main body.

Further, such locking member defines side edge walls extending along opposite side edges of said planar cover portions for insertion into a said second frame.

Further, said first frame comprises the border frame, and said second frame comprises the shutter frame, both being of extruded thermoplastic material.

Further, said shutter frame defines side portions and top and bottom portions, wherein one of said side portions is secured to hinges, and the other said side portion being free and open at both ends, and wherein a said locking member is inserted in each said open end, of said other side portion of said side frame.

Further, such locking member defines integrally moulded plug extensions, and said shutter side frame defines integrally formed plug recesses, said plug extensions making a frictional fit in said plug recesses, to hold said locking members in said ends of said side portion of said shutter frame.

Further, such lock strip arm members define a generally U-shape in section, on either side of said abutment to permit resilient flexing of said arm members.

Further, such border frame defines opposite side frame members, and top and bottom frame members, and such locking member has integral guide ribs on either side of said lock strip, said guide members defining generally convex edges, with a linear intermediate edge section, said guide ribs engaging said border frame, and said guide ribs registering said shutter frame in a predetermined position in said border frame, when said shutter frame is swung into its locked position.

Further, there are two said locking members on said other side portion of said side frame, one being installed in an upper end, and another being installed in a lower end of said side portion.

Preferably said two locking members are installed in a side portion of said shutter frame, and said recesses are formed in top and bottom portions of said border frame. The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

FIG. 2 is a section along line 2-2 of FIG. 1;

FIG. 3 is a lower perspective of a locking member;

FIG. 4 is an upper perspective of a locking member;

DESCRIPTION OF A SPECIFIC EMBODIMENT

Figure 1:
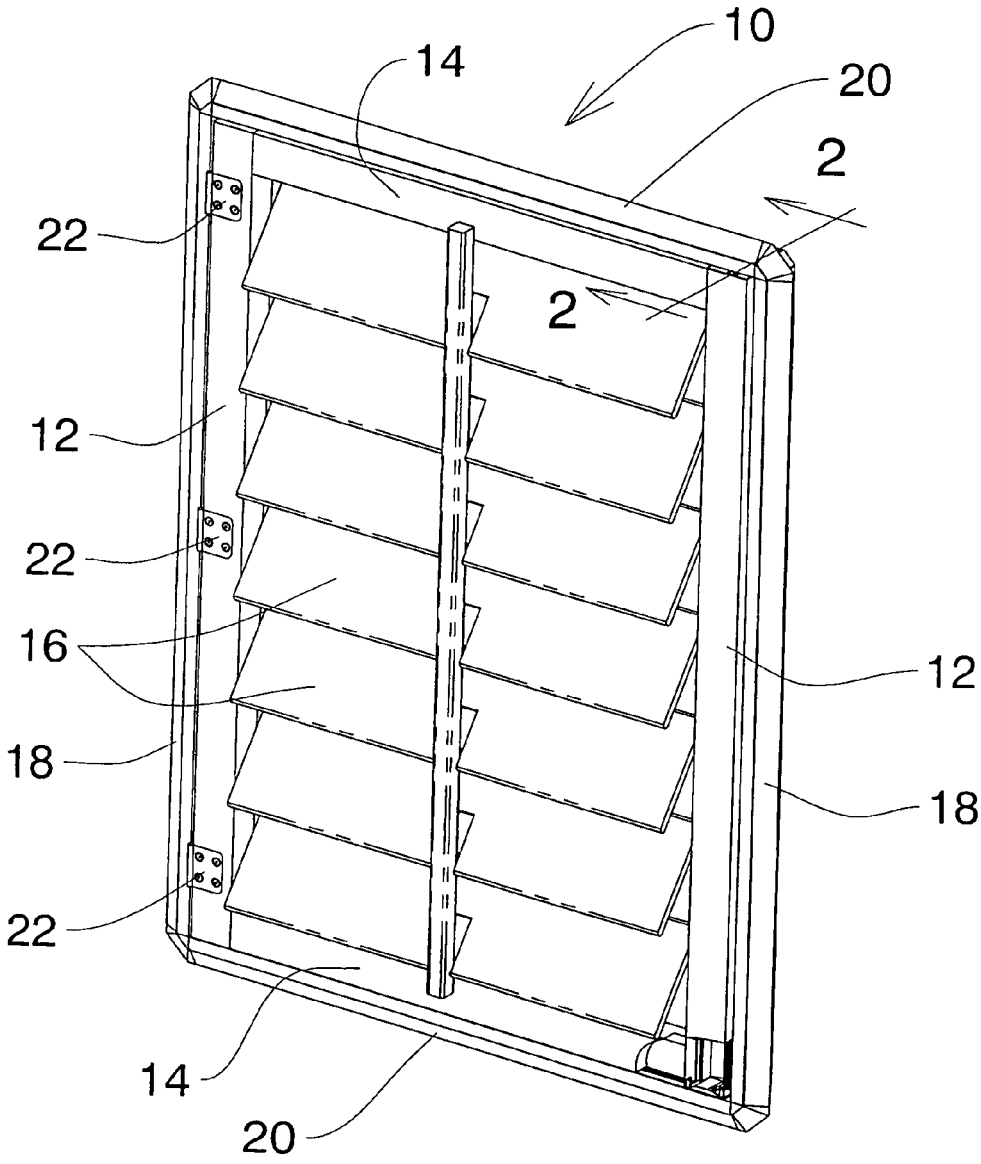
FIG. 1 is a perspective of a simple shutter showing a border frame, and a shutter frame hinged in said border frame, with the shutter frame swung into the open position, and a locking member shown exploded.
Figure 5:
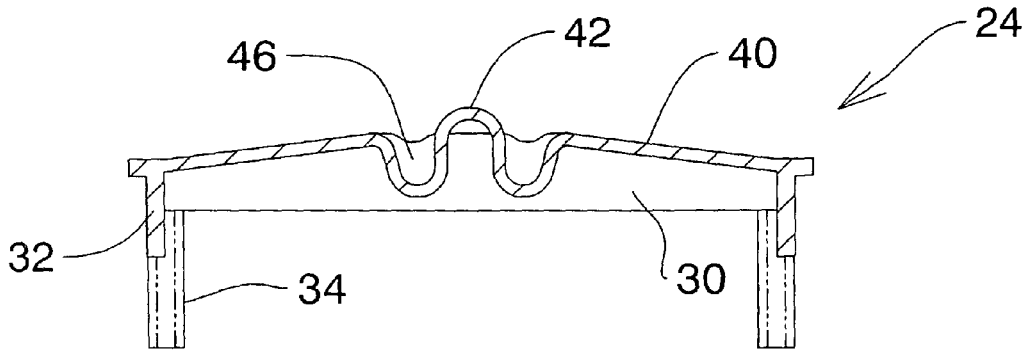
FIG. 5 is a section along line 5-5 of FIG. 4.
Figure 6:
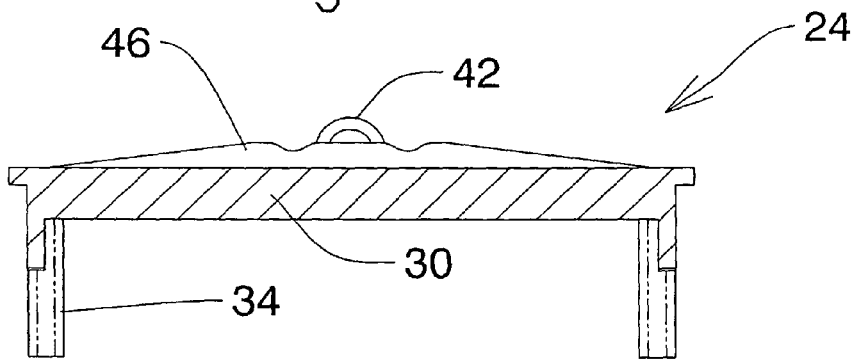
FIG. 6 is a section along line 6-6 of FIG. 4.
Figure 7:
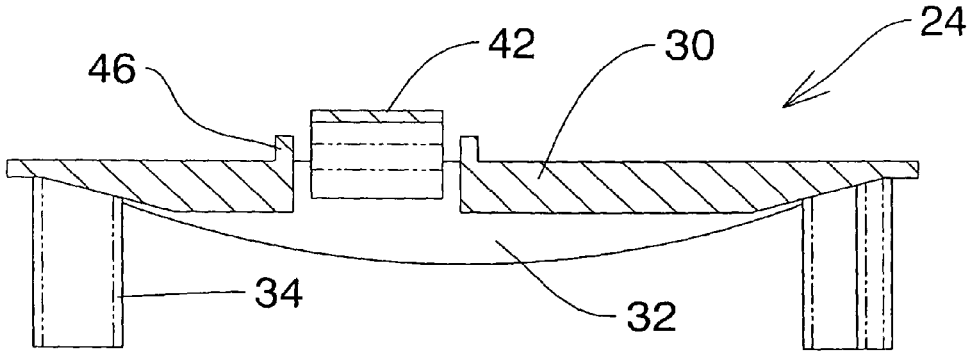
FIG. 7 is a section along line 7-7 of FIG. 4.

Referring to FIG. 1, this shows a simple form of shutter (10) having a shutter frame with side frame portions (12) and top and bottom frame portions (14). Louvres (16) are pivoted in the side frame portions (12), in the typical shutter. Usually a mounting or border frame having side frame portions (18) and top and bottom frame portions (20) is provided for the shutter.

Hinges (22) connect one side portion of the shutter frame with one side portion of the mounting frame. The invention is not to be taken as restricted solely to such a shutter, the illustration being merely by way of background, for a better understanding.

The shutter can thus be swung open, away from the mounting frame, or swung closed, when the shutter fits in the mounting frame.

It is desirable to provide some form of lock to hold the shutter frame closed, in the mounting frame.

Figure 8:
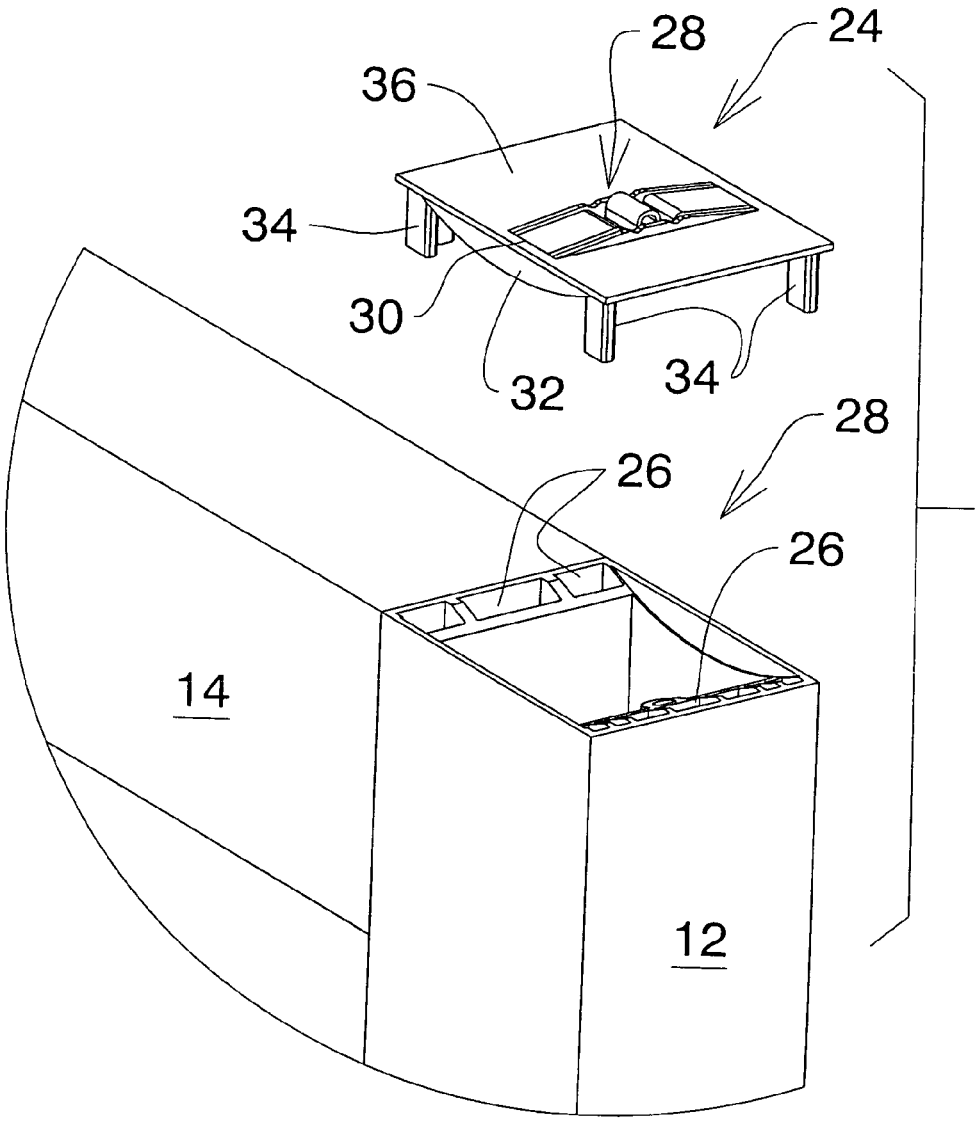
FIG. 8 is a perspective of one end of a shutter side frame, with a lock member shown exploded.

FIG. 1 illustrates such a shutter frame lock (24), there being two such locks, one being located at the top and one at the bottom end of one side portion of the shutter frame. As shown in FIG. 8 the shutter frame is formed of lengths of thermoplastic hollow extrusion, defining interior tubes or passages (26). The shutter frame side portions (12), and top and bottom frame portions (14) are joined at right angle butt joints at the four corners. The side frame portions define open top and bottom ends (28).

The top and bottom shutter frame portions (14) mate with the side portions (12) of the side frames, and are secured in any suitable manner, for example by adhesives, screw fastenings or the like not shown.

The mounting or border frame (18 and 20) will be attached to the building fabric, around an opening, for example a door or window.

The shutter frame, being hinged along one side frame portion to the mounting frame, can thus be swung into or out of the opening.

The lock members (24) will frictionally engage the top and the bottom of the mounting frame, when the shutter frame is swung into the mounting frame, and hold it closed. For this purpose each lock member (24) comprises a main body (30) which is generally planar and of rectangular shape in plan having the same approximate extent as the area of cross section of the shutter side frame portion.

The main body has side reinforcements (32), which can extend into the extrusion of the side frame portion, and integrally moulded plug portions (34), at all four corners. The plug portions are shaped to fit into female sockets or tubes (26) formed in the side frame portion (12), FIG. 8. They may be secured by adhesive.

Main body (30) has two planar portions (36) separated by space (38).

To provide a resilient frictional lock, a lock strip comprised of arms (40) is formed integrally with main body (30) and extends across the space ( ), but unconnected with the two planar portions.

Arms (40) are thus free to flex down and up.

Arms (40) are formed integrally with a sinusoidal shaped lock portion (42) which normally extends somewhat above the plane of the planar portions.

The lock portions can respond to pressure (from contact with the mounting frame top and bottom portions) to be retracted back more or less into the plane of the planar portions.

When the lock portions (42) register with the recess or grooves (44) in the mounting frame portions (20), the lock portions (42) can then extend into it and provide a frictional lock.

In order to provide some degree of location control for the shutter frame portions, side ribs (46) and formed integrally with planar portions (36). Ribs (46) are of a generally shallow convex profile, being lowest adjacent to the edge of the shutter frame and rising to a high point registering with the lock portion, more or less centrally of the top and bottom mounting frame frame portions (20).

Thus when the shutter is swung shut and is locked by the two lock portions (42), the location and registration of the shutter frame, in the mounting frame, is provided by the side ribs (46).

This will also provide support for the shutter frame, when locked shut, so that the pressure from the two locks is balanced out and is carried by the respective lock members.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A shutter frame lock formed of thermoplastic material incorporated between a shutter frame and a mounting frame and comprising;

a recess integrally formed in a first one of said frames;

a one piece moulded locking member secured in a second one of said frame said locking member defining a main body;

attachment extensions on said main body engageable with said second frame;

a flexible resilient lock strip integrally moulded with said main body, having a lock portion interlockable with said recess in said first frame, and, lock strip arm members defining generally U-shapes in section, on both side of said lock portion joining it to said main body to permit resilient flexing of said arm members;

and said locking member has integral ribs on both sides of said lock strip, said ribs defining generally convex edges with a linear intermediate edge section, said ribs engaging said first frame, and said ribs registering said shutter frame in a predetermined position when said shutter frame is swung into its locked position.

2. A shutter frame lock as claimed in claim 1 wherein said locking member defines generally planar cover portions on either side of said lock strip, and being spaced therefrom so as to permit said lock strip and flexible arms to flex relative to said main body.

3. A shutter frame lock as claimed in claim 1 wherein said locking member defines side edge walls extending along opposite side edges of said planar cover portions for insertion into a said second frame.

4. A shutter frame lock as claimed in claim 1 wherein said first frame comprises the mounting frame, and said second frame comprises the shutter frame, both being of extruded thermoplastic material.

5. A shutter frame lock as claimed in claim 1 wherein said shutter frame defines side portions and top and bottom portions, wherein one of said side portions is secured to hinges, and the other said side portion being free and open at both ends, and wherein a said locking member is inserted in each said open end, of said other side portion of said side frame.

6. A shutter frame lock as claimed in claim 1 wherein said extensions comprise integrally moulded plug extensions, and said shutter side frame defines integrally formed recesses, said plug extensions making a frictional fit in said recesses, to hold said locking members in said ends of said side frame portion.

7. A shutter frame lock as claimed in claim 1 wherein there are two said locking members on said other side frame, one being installed in an upper end, and another being installed in a lower end of said side portion.

8. A shutter frame lock as claimed in claim 1 wherein said two locking members are installed in a side portion of said shutter frame, and said recesses are formed in top and bottom portions of said mounting frame.

* * * * *